United States Patent [19]

Smith et al.

[11] 3,947,836

[45] Mar. 30, 1976

[54] ELECTRONIC PRESSURE CYCLE INDICATOR

[75] Inventors: Carl H. Smith, Spring Valley, N.Y.; August X. Sidler, Cham, Switzerland

[73] Assignee: Auto Research Corporation, Rochelle Park, N.Y.

[22] Filed: Oct. 25, 1974

[21] Appl. No.: 518,041

[52] U.S. Cl. ..... 340/270; 340/309.1; 184/6.4

[51] Int. Cl.[2] ..... F01M 1/20; G08B 21/00

[58] Field of Search..... 340/309.1, 270, 234, 239 R; 307/272, 308, 293; 184/6.4; 137/12; 324/61 R, 71 SN; 73/37, 194 R, 194 E, 195, 206, 398 R, 398 C; 328/127

[56] References Cited

UNITED STATES PATENTS

| | | | |
|---|---|---|---|
| 3,583,528 | 6/1971 | Beukelaer | 340/270 |
| 3,656,140 | 4/1972 | Gruber | 340/270 |
| 3,748,656 | 7/1973 | Gray | 340/240 |

*Primary Examiner*—John W. Caldwell
*Assistant Examiner*—William M. Wannisky
*Attorney, Agent, or Firm*—Ostrolenk, Faber, Gerb & Soffen

[57] ABSTRACT

Fluid pressure sensing means for sensing lubricant pressure levels. Means are activated to turn on a pump at regular intervals to provide lubrication at such intervals. It is desired to indicate failure of subsequent operation of the pump after a time interval greater in duration than the aforesaid periodic intervals. Pump operation causes closure of pressure switch which causes capacitance means to charge during the switch closure interval. As soon as the capacitance is charged beyond a predetermined threshold level, bistable means are set which in turn sets up a discharge path for the capacitor. The long-time constant of the discharge path, which is adjustable and which typically may be of the order of hours, continues until the voltage across the capacitor drops below a second predetermined threshold level resetting the bistable flip-flop. The reset operation triggers a switch means for illuminating a lamp which indicates that a prolonged period of time has occurred since the last pump operation. Recharging of the capacitance does not occur until the pressure switch again undergoes a switch closure operation which automatically sets the bistable flip-flop and turns the lamp off. Operation of the circuitry so as to charge the capacitor rapidly and allow for a slow discharge rate serves to substantially reduce capacitance leakage problems.

7 Claims, 2 Drawing Figures

10
11
11a
11b
11c
11d
11e
11f
12
13a
13b
13c
14
21
21a
21b
21c
22
23
24
25
26
26a
26b
26c
26d
26e
26f
26g
26h
27
28
29
29a
30
30a
30b
31
A
B
D
R1
R2
R3
R4
R5
CR1
CR2
C1
C2
C3
SIGNAL LIGHT
B+

ELECTRONIC PRESSURE CYCLE INDICATOR

The present invention relates to warning devices and more particularly to a novel warning device having an extremely long time delay period for monitoring a cyclic fluid pressure condition.

BACKGROUND OF THE INVENTION

In lubricant systems it is typical to provide a cyclically operable lubricant pumping apparatus which is periodically operated to build lubricant pressure to a suitable level. The lubricant under pressure is then metered to provide a measured flow of the lubricant to the equipment being so lubricated.

Since the metering of the flow of lubricant is adjusted to provide lubricating fluid sufficient for a substantial operating interval, the pump is typically operated to supply lubricant at intervals separated by substantially long time periods which are usually of the order of hours. However, it is very important to be assured that the pump is in fact operating properly since failure in providing adequate lubricant flow may cause severe damage to the equipment being so lubricated, necessitating the use of circuitry which is capable of developing time delays which are of the order of a few hours.

Various systems have been devised to ascertain whether automatically operating cyclic liquid dispensing apparatus is operating properly or is malfunctioning. A conventional sensing device for determining whether there has been a malfunction comprises a pressure sensing device for sensing system pressure after each periodic pulse of liquid pressure. Such devices are coupled with a timing device for generating a time interval that is slightly longer than the time that elapses between pump operations, so that if a pulse of liquid at the correct pressure is not sensed within a predetermined timer period, an indication is given that a malfunction has occurred. The pressure sensing device is associated with an automatic reset timer. The pressure sensing device resets the timing device by activating a reset device in the timing device. An indicator device is connected with the pressure sensing device to indicate when the pressure sensing device has responded to an underpressure due to a malfunction in the system. Such prior art systems are expensive since they require a pressure sensing device, a complex and expensive timer and a complex and expensive recycling means.

An effort to obtain similar operations through a less expensive apparatus led to the development of the hydraulic pressure cycle indicator described in U.S. Pat. No. 3,583,528. One disadvantage of this system resides in the fact that large time variations occur due to changes in lubricant viscosity with ambient temperature thereby significantly altering the bleed-off interval.

BRIEF DESCRIPTION OF THE INVENTION

The present invention is characterized by providing a novel inexpensive time delay circuit capable of providing extremely long time delay periods before time-out, which periods are typically of the order of hours, so as to provide an indication in the form, for example, of a warning light, of the fact that the pump is operating properly and/or that the periodic flow of lubricant has not been terminated for a prolonged and abnormal period of time since its last interval of activation. Of course, alternate warning systems can be used or the connection could be directly to the apparatus being lubricated to shut it down because of the interruption of full lubrication, etc.

In the present invention, a pressure switch means is activated simultaneously with the flow of lubricant under control of a pump to cause rapid charging of a capacitor. Once the capacitor is charged to a predetermined threshold, this state is detected by a first comparator which serves to set a bistable flip-flop circuit. The setting of the bistable flip-flop circuit simultaneously actuates a switch means to deactivate the warning lamp, or the like, and provides a discharge path for the capacitor. The capacitor is coupled in series with a resistor to form an RC time constant having long time intervals, usually of the order of hours. The capacitor discharges through a discharge path comprised of a transistor which has been driven to the conduction state through the setting of the bistable flip-flop. The capacitor begins discharging at a very slow rate. The voltage across the capacitor is monitored by a second comparator circuit which serves to reset the bistable flip-flop circuit as soon as the voltage across the capacitor drops below a second predetermined threshold level. As soon as the bistable flip-flop circuit is reset, the discharge circuit transistor is driven into cut-off preventing any further discharge. The resetting of the bistable flip-flop circuit further causes activation of the switch means in circuit with the warning lamp, or the like, to cause the warning device to be activated.

When lubricant is pumped before the voltage across the capacitor drops below the second predetermined threshold level, the capacitor is rapidly recharged to its maximum level preventing the bistable flip-flop circuit from being reset so as to prevent the generation of an erroneous warning lamp indication. The first comparator circuit also serves as a means for indicating that the capacitor has been properly charged.

BRIEF DESCRIPTION OF THE DRAWINGS AND OBJECTS

It is therefore one primary object of the present invention to provide a novel monitoring circuit including timing means for developing a warning indication whenever the time between intervals of lubricant flow are abnormally long.

The above as well as other objects of the present invention will become apparent from a consideration of the ensuing description and drawings.

DETAILED DESCRIPTION OF THE INVENTION AND FIGURES

Figure 1:
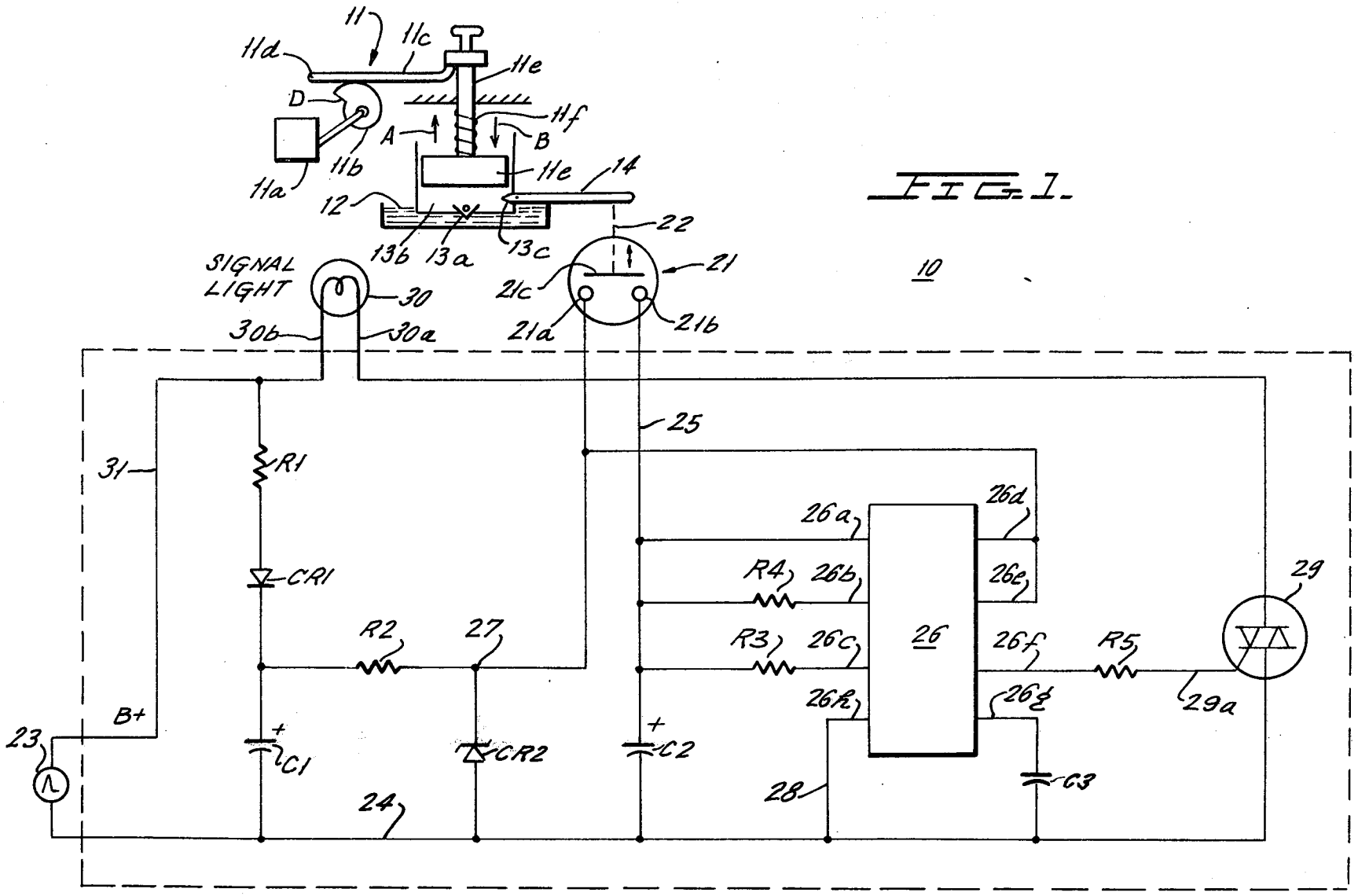
FIG. 1 is a schematic diagram showing a monitoring circuit embodying the principles of the present invention.

FIG. 1 shows a schematic diagram of monitoring means 10 embodying the principles of the present invention and which is comprised of a cyclic lubricating system 11. Such systems are described in U.S. Pats. No. 3,091,306; 3,072,300; 2,856,024; 2,784,808, among others. A typical one of these systems comprises a continuously operating motor **11*a* driving a cam 11*b***. Although the invention is described as being utilized in conjunction with a lubricating system, it should be understood that this description is merely exemplary and that the invention may be employed in any hydraulic system whether motor or non-motor driven and is especially advantageous for use in hydraulic systems which experience fluctuating pressures.

The cam 11*b* is a gradually increasing radius eccentric cam with a sharp drop-off D. As the cam 11*b* rotates, it engages and pivots the lever 11*c* which is pivoted at 11*d*. Lever 11*c* engages a piston 11*e* that is spring loaded by a helical spring 11*f*. Cam 11*b* rotates counterclockwise, lever 11*c* rides out of drop-off D and the piston 11e is driven slowly in the direction shown by arrow A against the force of spring 11*f*. This causes lubricant to be gradually drawn from reservoir 12 through check valve 13a into pump cylinder 13*b*. The piston continues to rise slowly against the downward force of spring 11*f* until drop-off D engages lever 11*c*. Then, the charged spring 11*f* rapidly moves piston 11*e* in the reverse direction shown by arrow B, forcing lubricant from cylinder 13*b* through check valve 13*c* through distribution conduit 14. The discharge pressure in the conduit 14 rapidly reaches its maximum pressure and then decreases to zero as the lubricant flow to bearings and the like in an apparatus 15 being lubricated. The pressure in conduit 14 remains essentially at zero until the occurrence of the next discharge cycle.

Pressure switch 21 is one constituent of the monitoring means 20 which in turn is comprised of an AC source 23 coupling an AC signal across a series path comprised of resistor R1, diode CR1 and capacitor C1. Diode CR1 serves to half-wave rectify the AC signal source. Resistor R1 provides surge protection to protect diode CR1 during periods of initial turn-on of the equipment. The pressure switch for the electronic pressure cycle indicator is preferably located at the end 14a of the main line in the distribution system; however, it can be located at any point in the distribution system. The pressure switch closes charging the capacitor C2 when the pressure in the distribution line rises at the beginning of the oil discharge cycle. The switch remains closed until the pressure in the line drops below the operating pressure of the pressure switch. The time that the switch remains closed will be typically of the order of one minute for an hour cycle time. The capacitor commences to discharge when the switch opens, and the circuit will time out unless another pressure pulse causes the capacitor to be recharged before the end of the circuit's time period.

Capacitor C1 serves to filter the half-wave rectified voltage. The common terminal between diode CR1 and capacitor C1 is coupled through a resistor R2 to a Zener diode CR2 whose opposite terminal is connected to ground bus 24. Zener diode CR2 serves to regulate the DC voltage employed in the monitoring circuitry. The common terminal between resistor R2 and Zener diode CR2 is coupled to one stationary terminal 21A of swith 21. The opposite stationary terminal 21B is coupled through line 25 to capacitor C2 whose opposite terminal is connected to ground bus 24. Pressure switch 21 is further provided with movable arm 21c which operates to provide a direct shunt path across stationary terminals 21a and 21b upon the operation of pump 12.

Capacitor C2 has its (+) terminal connected to terminal 26*a* of a monitoring circuit 26. The (+) terminal of capacitor C2 is further coupled to terminal 26*c* through resistor R3.

Terminals 26*d* and 26*e* of monitoring circuit are connected in common to the common terminal 27 between resistor R2 and Zener diode CR2. Terminal 26*g* of circuit 26 is coupled through capacitor C2 to reference bus 24. Terminal 26*h* is coupled directly to ground reference bus 24 through line 28. Output terminal 26*f* of circuit 26 is coupled through resistor R5 to the trigger electrode 29*a* of a control switch 29 whose cathode electrode is connected to the ground reference 24 and whose anode electrode is connected to one terminal 30*a* of lamp 30, whose opposite terminal 30*b* is directly connected to AC source 23 through line 31.

Figure 2:
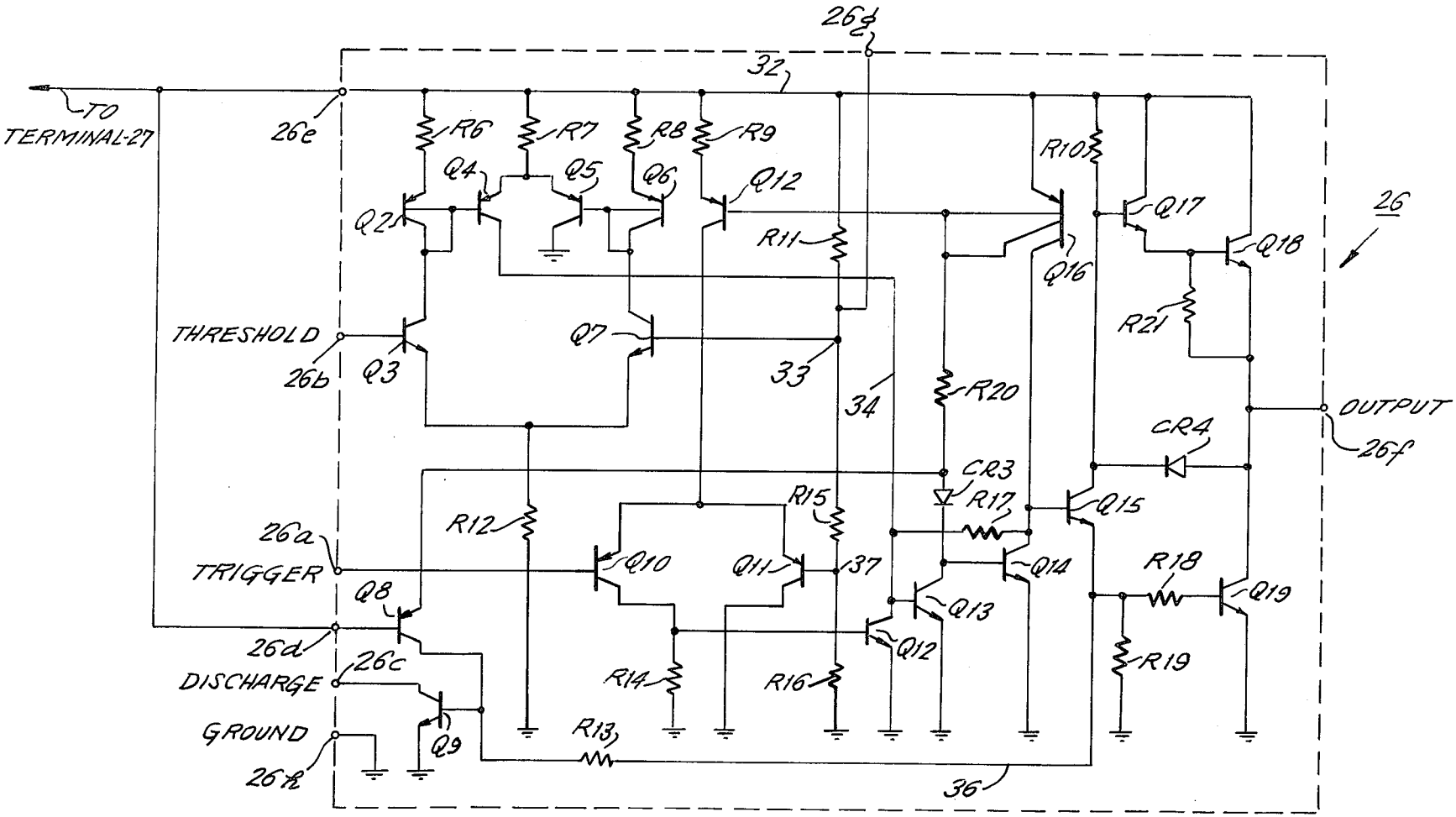
FIG. 2 shows a detailed circuit diagram of the timing means shown in block diagram form in FIG. 1.

FIG. 2 shows a detailed schematic diagram of circuit 26 whose terminals 26*e* and 26*d* are connected in common to terminal 27. Terminal 26*a* is directly coupled to the (+) terminal of capacitor C2. Terminals 26*b* and 26*c* are coupled to resistors R4 and R3, respectively. Terminal 26*h* is connected to ground reference bus 24. Terminal 26*g* is coupled to capacitor C3, while terminal 26*f* is coupled to resistor R5.

Terminal 26*e* is coupled to common bus 36 which serves to provide B+ voltage to circuit 26.

Transistors Q2, Q3, Q4, Q5, Q6 and Q7 form a comparator for providing an output when the capacitor C2 has been charged above the first predetermined threshold level. This threshold level is established by resistors R11, R15, R16 which are connected in series between B+ bus 32 and ground. The common terminal 33 between resistors R11 and R15 is coupled to the base electrode of transistor Q7 and this level serves as the first predetermined threshold. The monitored input is coupled to input terminal 26*b* and to the base electrode of transistor Q3. When the level at terminal 26b exceeds the first predetermined threshold level at terminal 33, transistor Q4 conducts to provide a positive output level at its collector circuit which is coupled through line 34 to the base electrode of transistor Q13. Transistors Q13 and Q14 form a bistable flip-flop circuit, the collector of Q13 being directly connected to the base of Q14, and the collector of Q14 being connected to the base of Q13 through resistor R17.

When a positive level is applied to the base of Q13, Q13 conducts causing its collector to be substantially at ground. This renders Q14 non-conductive causing its collector to be substantially at the B+ level thereby driving Q15 into conduction. Current flow through the Q15 emitter developing an IR drop across resistor R19. This positive voltage level is applied through line 36 and resistor R13 to the base of Q9 causing Q9 to conduct. The emitter of Q9 is connected to ground potential while the collector of Q9 is connected to terminal 26*c* which, in turn, is connected to capacitor C2 through resistor R3. Just as soon as the capacitor C2 exceeds the first predetermined threshold level established at terminal 33, the bistable flip-flop circuit is set causing transistor Q9 to conduct thereby providing a discharge path for capacitor C2. Capacitor C2 discharges through resistor R3 and conducting transistor Q9 to ground. The discharge rate of capacitor C2 is established by the capacitance value of C2 and the resistance value of R3 which values are chosen so as to provide a very slow discharge rate, typically of the order of hours.

The discharge rate of capacitor C2 is monitored by a second comparator circuit comprised of transistors Q10 and Q11. The base of Q11 is coupled to the common terminal 37 between resistors R15 and R16 to establish a second predetermined threshold level. At this time transistor Q10 is non-conductive and remains in a non-conducting state until its base electrode drops below the aforementioned predetermined second threshold level. As soon as this condition occurs, Q10 conducts developing an IR drop across R14 to apply a positive level to the base of Q12 causing Q12 to conduct. The collector of Q12 goes substantially to ground potential causing Q13, which forms a bistable flip-flop circuit with Q14, to be turned off causing its collector to go high. This renders Q14 conductive causing its collector to go substantially to ground which causes turn-off of transistor Q15. This causes the emitter of Q15 to drop substantially to zero which turns transistor Q9 off, preventing any further discharge of capacitor C2.

Simultaneously therewith, the turn-off of transistor Q15 causes the base of Q17 to go high turning Q17 on. In addition thereto, zero reference level at the emitter of Q15 is coupled through R18 to the base of Q19, causing Q19 to be turned off. This removes ground reference level from terminal 26*f*. Simultaneously therewith, the turn-on of Q17 causes Q18 to be turned on thereby causing output terminal 26*f* to go high. This condition is coupled through R5 to the trigger electrode 29*a* of silicon-controlled switch 29 rendering the switch conductive, and establishing a closed circuit path between ground reference bus 24, switch 29, lamp 30 and AC source 23, thereby illuminating lamp 30. If desired, the circuit containing lamp 30 may also include an audible alarm and if further desired may include means for turning off the equipment 15 being lubricated. The triac 29 alternatively may be replaced with a normally closed switching means so as to illuminate lamp 30 during normal operation of the lubricating system. The signal appearing at terminal 26*f* upon failure would open the switch to turn off the lamp 30 during abnormal operation. Also using a double throw switching means, two lights may be provided so that one is lit during normal operation and the other is lit during abnormal operation. Other warning indicators, either local or remote, may be connected directly to the output 26f either in place of lamp 30 or in addition thereto.

In cases where the lubricant system 11 is functioning properly, closure of switch arm 21c will occur before capacitor C2 discharges below the second predetermined threshold level established at terminal 37, thereby causing the comparator comprised of transistors Q2 to Q7 to set the bistable flip-flop comprised of transistors Q13 and Q14, which bistable flip-flop serves to couple terminal 26f to ground by rendering Q19 conductive and which further simultaneously serves to turn on Q9 to begin another discharge cycle for capacitor C2. The comparator comprised of Q2–Q7 also serves as a means for indicating that C2 has been properly and fully charged upon closure of switch 21. Capacitance leakage problems are reduced by operating C2 and R3 to discharge over a long time period, to thereby establish the desired long time interval.

It can be seen from the foregoing description that the present invention provides a novel monitoring circuit for monitoring the operation of a pump with a lubricating system by providing an extremely long time delay circuit which will time out only in cases where the interval between activations of pump 12 is abnormally long. Normally lubricant is pumped at intervals spaced apart in time over a range from 0.4 to 3.0 hours and in order to prevent danger to unlubricated components 15, the long time delay is set so as to be longer than the normal range of successive activation of the lubricating operation and shorter than a time period in which the production of the pressure level in the lubricating conduits 14 will drop to a dangerous level.

It should also be noted that by locating the pressure switch 21 near the apparatus 15 being lubricated, the alarm system also monitors any clogging or blockage in the distribution network which may be the cause of the problem rather than breakdown of the lubricating system.

Although there have been described preferred embodiments of this novel invention, many variations and modifications will now be apparent to those skilled in the art. For example, switch 21 may be maintained normally closed and may open upon the occurrence of flow of lubrication. In this arrangement C2 may be rapidly discharged upon the flow of lubrication and be slowly charged when the lubricant pressure drops to zero. For this embodiment, R3 must be connected across the (+) terminal of C2 and terminal 26*d*, all connections must be removed from terminal 26*a*, and switch 21 must be connected across the (+) terminal of C2 and bus 24. The lamp will be normally on and turn off indicating failure. Therefore, this invention is to be limited, not by the specific disclosure herein, but only by the appended claims.

What is claimed is:

1. In a lubricating system for lubricating apparatus and having a source of lubricating fluid; conduit means for coupling said lubricant to said apparatus; means for periodically and cyclically dispensing lubricant from said source to said conduit means, the improvement comprising a circuit for providing a warning indication in cases where lubricant dispensing is terminated for abnormal and/or prolonged time periods, said circuit comprising:

a capacitor;

a power source;

first switch means activated by the presence of lubricant in said conduit means for coupling said capacitor to said power source;

first reference means coupled to said power source for establishing a first predetermined threshold voltage;

first comparator means coupled to said capacitor and said first reference means for generating an output signal when the voltage across said capacitor exceeds said first predetermined threshold;

a bistable flip-flop having a set and reset state and having a first input coupled to said first comparator means;

said flip-flop being set when said first comparator means generates an output signal;

a discharge path for controlling the discharge of said capacitor;

discharge means coupled to said flip-flop for providing coupling the discharge path to said capacitor when said flip-flop is in the set state;

a warning device and second switch means coupled across said power source;

said second switch means having a control input coupled to said flip-flop and being turned off when said flip-flop is in the set state;

second means coupled to said power source for developing a second predetermined threshold;

second comparator means coupled to said second means and said capacitor for developing an output signal when the voltage across said capacitor drops below said second predetermined threshold;

said flip-flop having a second input coupled to said second comparator means and being driven to the reset state when said second comparator means develops an output signal;

said discharge means being rendered non-conductive when said flip-flop is driven to the reset state;

said second switch means being turned on when said flip-flop is in the reset state causing activation of said warning device.

2. The apparatus of claim 1 wherein said warning device comprises a lamp.

3. The apparatus of claim 1 wherein said warning device comprises an audible alarm means.

4. The apparatus of claim 1 wherein said discharge path further comprises a resistor coupled between said capacitor and said discharge control means for controlling the discharge rate of said capacitor.

5. The apparatus of claim 1 further comprising second (Q18) and third (Q19) transistor means coupled in series across said power source and each having a control terminal;

third switch means (Q15) having an input coupled to the output of said flip-flop and having first Q15 collector and second Q15 emitter outputs respectively coupled to the control terminals of said second (Q18) and third (Q19) transistor means for turning only said second transistor means ON when said flip-flop is in the set state to turn OFF said third switch means and for turning only said third transistor means ON when said flip-flop is in the reset state to turn ON said third switch means.

6. The apparatus of claim 1 wherein said discharge means is comprised of a transistor having its collector and emitter electrodes respectively coupled to said capacitor and ground reference, and a base electrode coupled to said flip-flop.

7. Timing means for monitoring a condition occurring in a cyclical periodic fashion to provide an alarm condition when the time period between said periodic operations is abnormally long comprising:

a power source;

a capacitor;

first switch means being activated upon each occurrence of said condition to couple said power source to the capacitor;

first reference means coupled to said power source for establishing a first predetermined threshold voltage;

first comparator means coupled to said capacitor and said first reference means for generating an output signal when the voltage across said capacitor exceeds said first predetermined threshold;

a bistable flip-flop having a set and reset state and having a first input coupled to said first comparator means;

said flip-flop being set when said first comparator means generates an output signal;

discharge means coupled to said flip-flop for providing a discharge path for said capacitor when said flip-flop is in the set state;

a warning device and second switch means coupled across said power source;

said second switch means having a control input coupled to said flip-flop and being turned off when said flip-flop is in the set state;

second means coupled to said power source for developing a second predetermined threshold;

second comparator means coupled to said second means and said capacitor for developing an output signal when the voltage across said capacitor drops below said second predetermined threshold;

said flip-flop having a second input coupled to said second comparator means and being driven to the reset state when said second comparator means develops an output signal;

said discharge means being rendered non-conductive when said flip-flop is driven to the reset state;

said second switch means being turned on when said flip-flop is in the reset state causing activation of said warning device.

* * * * *